US008844200B2

(12) United States Patent
Yulkowski et al.

(10) Patent No.: US 8,844,200 B2
(45) **Date of Patent: *Sep. 30, 2014**

(54) ELECTRICAL DOOR OPERATOR

(75) Inventors: Leon Yulkowski, Bloomfield Hills, MI (US); Gerard Edwards, Centerville, OH (US); Steve Gebhart, Tipp City, OH (US)

(73) Assignees: Globe Motors, Inc., Dayton, OH (US); Leon Yulkowski, Bloomfield, MI (US)

( * ) Notice: Subject to any disclaimer, the term of this patent is extended or adjusted under 35 U.S.C. 154(b) by 208 days.

This patent is subject to a terminal disclaimer.

(21) Appl. No.: 12/719,954

(22) Filed: Mar. 9, 2010

(65) Prior Publication Data

US 2010/0242368 A1 Sep. 30, 2010

Related U.S. Application Data

(63) Continuation-in-part of application No. 12/416,622, filed on Apr. 1, 2009, now Pat. No. 8,261,491.

(60) Provisional application No. 61/054,952, filed on May 21, 2008, provisional application No. 61/041,696, filed on Apr. 2, 2008.

(51) Int. Cl.

| | |
|---|---|
| ***E05F 15/12*** | (2006.01) |
| ***E05F 15/20*** | (2006.01) |
| *E05F 15/00* | (2006.01) |

(52) U.S. Cl.

CPC ..... *E05F 15/20* (2013.01); *E05F 15/127* (2013.01); *E05Y 2400/814* (2013.01); *E05Y 2400/532* (2013.01); *E05Y 2400/326* (2013.01); *E05F 2015/0086* (2013.01); *E05Y 2900/132* (2013.01); *E05Y 2400/514* (2013.01); *E05Y 2400/51* (2013.01); *E05F 15/2015* (2013.01); *E05Y 2400/822* (2013.01); *E05F 15/2007* (2013.01); *E05F 15/2023* (2013.01); *E05F 15/00* (2013.01); *E05Y 2400/512* (2013.01); *E05F 15/0004* (2013.01); *E05Y 2800/40* (2013.01)

USPC ..... 49/358; 49/25; 49/31; 49/138; 49/359; 49/280; 49/300

(58) Field of Classification Search

USPC ..... 49/25, 31, 138, 358, 359, 279, 280, 49/300, 302

See application file for complete search history.

(56) References Cited

U.S. PATENT DOCUMENTS

| | | | |
|---|---|---|---|
| 4,333,268 | A | 6/1982 | Dumbeck |
| 4,562,664 | A | 1/1986 | Kambic |

(Continued)

FOREIGN PATENT DOCUMENTS

| | | |
|---|---|---|
| DE | 102007038421 | 9/2008 |
| WO | 2008/078029 | 7/2008 |

(Continued)

OTHER PUBLICATIONS

6 Pages, U.S. Appl. No. 13/589,471, mailed May 13, 2013.

(Continued)

*Primary Examiner* — Katherine Mitchell
*Assistant Examiner* — Marcus Menezes
(74) *Attorney, Agent, or Firm* — Evan Law Group LLC

(57) ABSTRACT

A door operator for use with a door includes an arm that extends from the door operator. The door operator includes a motor moving the arm to move the door between a closed position and an open position and between the open position and the closed position. A current sensor generates a current signal corresponding to the current to the motor. A position sensor in communication with the door arm generates a position signal corresponding to the position of the door relative to the frame. A controller communicates with the sensor and the motor. The controller controls a motor current to the motor in response to the current signal and the position signal.

22 Claims, 8 Drawing Sheets

(56) References Cited

U.S. PATENT DOCUMENTS

| | | | | |
|---|---|---|---|---|
| 4,698,937 | A | 10/1987 | Kornbrekke et al. | |
| 4,727,679 | A * | 3/1988 | Kornbrekke et al. | 49/138 |
| 4,952,080 | A * | 8/1990 | Boiucaner et al. | 388/811 |
| 4,980,618 | A | 12/1990 | Milnes et al. | |
| 5,018,304 | A * | 5/1991 | Longoria | 49/340 |
| 5,040,331 | A * | 8/1991 | Merendino et al. | 49/25 |
| 5,583,405 | A | 12/1996 | Sai et al. | |
| 5,770,934 | A | 6/1998 | Theile | |
| 5,878,530 | A * | 3/1999 | Eccleston et al. | 49/139 |
| 6,049,287 | A * | 4/2000 | Yulkowski | 340/693.12 |
| 6,183,023 | B1 | 2/2001 | Yulkowski | |
| 6,259,352 | B1 | 7/2001 | Yulkowski et al. | |
| 6,318,024 | B1 | 11/2001 | Krsnak et al. | |
| 6,336,294 | B1 * | 1/2002 | Kowalczyk et al. | 49/339 |
| 6,338,693 | B1 | 1/2002 | Scholten et al. | |
| 6,481,160 | B1 | 11/2002 | Kowalczyk | |
| 6,553,238 | B1 | 4/2003 | Ginzel et al. | |
| 6,553,717 | B2 | 4/2003 | St. John et al. | |
| 6,705,047 | B2 * | 3/2004 | Yulkowski | 49/346 |
| 6,715,586 | B1 | 4/2004 | Shubin | |
| 6,751,909 | B2 | 6/2004 | Ranaudo | |
| 6,788,000 | B2 | 9/2004 | Appelberg et al. | |
| 6,854,565 | B2 | 2/2005 | Peralaet et al. | |
| 6,967,451 | B2 * | 11/2005 | Miyauchi | 318/443 |
| 6,970,085 | B2 | 11/2005 | Okabe et al. | |
| 6,988,594 | B2 | 1/2006 | Deplazes et al. | |
| 7,070,226 | B2 | 7/2006 | Cleland et al. | |
| 7,143,548 | B2 * | 12/2006 | Kleinmann et al. | 49/345 |
| 7,224,275 | B2 | 5/2007 | Fitzgibbon | |
| 7,263,802 | B2 | 9/2007 | Fitzgibbon et al. | |
| 7,316,096 | B2 * | 1/2008 | Houser et al. | 49/345 |
| 7,382,063 | B2 * | 6/2008 | Mullet et al. | 307/64 |
| 7,493,726 | B2 | 2/2009 | Fitzgibbon et al. | |
| 8,653,982 | B2 | 2/2014 | Yulkowski et al. | |
| 2002/0026750 | A1 | 3/2002 | St. John et al. | |
| 2002/0104266 | A1 | 8/2002 | Ranaudo | |
| 2003/0005639 | A1 * | 1/2003 | Kowalczyk | 49/340 |
| 2003/0217894 | A1 | 11/2003 | Perala et al. | |
| 2004/0187387 | A1 * | 9/2004 | Hedrich | 49/25 |
| 2004/0251868 | A1 | 12/2004 | Sato et al. | |
| 2005/0198063 | A1 | 9/2005 | Thomas et al. | |
| 2005/0217097 | A1 | 10/2005 | Solfronk | |
| 2006/0167656 | A1 | 7/2006 | Shimonishi | |
| 2006/0244271 | A1 | 11/2006 | Hass | |
| 2006/0267409 | A1 * | 11/2006 | Mullet et al. | 307/64 |
| 2007/0193220 | A1 | 8/2007 | Daniels | |
| 2008/0061963 | A1 | 3/2008 | Schnitz et al. | |
| 2008/0203760 | A1 | 8/2008 | Cafeo et al. | |
| 2008/0209228 | A1 | 8/2008 | Chandler | |
| 2008/0246607 | A1 | 10/2008 | Smith | |
| 2009/0185197 | A1 | 7/2009 | Wilson et al. | |
| 2009/0249699 | A1 | 10/2009 | Yulkowski | |
| 2010/0114525 | A1 | 5/2010 | Ollivier et al. | |
| 2011/0016971 | A1 | 1/2011 | Yulkowski et al. | |
| 2013/0118079 | A1 | 5/2013 | Yulkowski et al. | |
| 2014/0182206 | A1 | 7/2014 | Yulkowski et al. | |

FOREIGN PATENT DOCUMENTS

| | | |
|---|---|---|
| WO | PCT/US2010/027423 | 6/2010 |
| WO | PCT/US2010/042286 | 4/2011 |
| WO | PCT/US2010/027423 | 10/2011 |
| WO | PCT/US2010/042286 | 2/2012 |

OTHER PUBLICATIONS

5 Pages, May 1, 2012, U.S. Appl. No. 12/719,954.
4 Pages, May 8, 2012, U.S. Appl. No. 12/416,622.
3 Pages, Jan. 30, 2012, U.S. Appl. No. 12/416,622.
19 Pages, Sep. 16, 2011, U.S. Appl. No. 12/416,622.
5 Pages, Jul. 25, 2011, U.S. Appl. No. 12/416,622.
11 Pages, Apr. 20, 2012, U.S. Appl. No. 12/416,622.
4 Pages, Oct. 23, 2012, U.S. Appl. No. 12/719,954.
23 Pages, Jul. 5, 2012, U.S. Appl. No. 12/719,954.
3 Pages, Jun. 5, 2012, U.S. Appl. No. 12/719,954
20 Pages, Jan. 28, 2013, U.S. Appl. No. 12/837,194.
30 Pages, Feb. 14, 2013, U.S. Appl. No. 12/719,954.
International Search Report dated Jun. 18, 2010 for PCT application No. PCT/US2010/027423.
16 Pages, Aug. 27, 2013, U.S. Appl. No. 12/837,194.
27 Pages, Oct. 3, 2013, U.S. Appl. No. 13/589,471.

* cited by examiner

ELECTRICAL DOOR OPERATOR

CROSS-REFERENCE TO RELATED APPLICATIONS

This application is a continuation-in-part of U.S. application Ser. No. 12/416,622, filed on Apr. 1, 2009 which claims the benefit of U.S. Provisional Application Nos. 61/041,696, filed on Apr. 2, 2008 and 61/054,952, filed on May 21, 2008. The entire disclosures of each of the above applications are incorporated herein by reference.

FIELD

The present disclosure is related to door operators and, more specifically, to electrically-operated door operators.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Installing doors into buildings under construction typically requires the assistance of various tradesmen. For example, for one opening, tradesmen such as carpenters, painters, glaziers, electricians, and drywallers are required to complete the installation of the door. Other tradesmen may also be used for the installation of the door. The number of tradesmen increases when the door has security or other specialty items incorporated near the door opening. Reducing the number of tradesmen will reduce the overall cost of the door when installation is included. Also, a reduction in human factors may also be reduced.

Door operators are typically designed around the concept of a return spring capable of exerting latching pressure with a spring alone. For example, many return springs provide about 15 lbs. of latching pressure using a spring. A motor large enough to overcome the spring pressure must be provided to operate a door operator. A door operator is capable of moving a door from an open position to a closed position, as well as from a closed position to an open position. Because of the size of the spring and the motor, a box that is approximately 6"×6"×36" is mounted, in plain view, over the door opening to house the motor and spring. Providing such door hardware in plain view may reduce the aesthetic appeal of the opening.

SUMMARY

The present disclosure provides a door operator assembly that does not include a return spring. Further, the electrical door operator is concealed within the door to provide a more aesthetically-pleasing door assembly. A conventional operator or closer develops increasingly high closing pressures as the door is opened putting handicapped or elderly people in danger of injury. This pressure approximates 20 pounds. The operator pressure according to the present disclosure can be maintained to a significantly lower pressure during the full operational distance. Forces in the 1 to 2 pounds range are possible.

In one aspect of the invention, a springless door operator for a door includes an arm extending from the door operator. The door operator includes a motor moving the arm to move the door between a closed position and an open position and between the open position and the closed position. A current sensor generates a current signal corresponding to the current to the motor. A position sensor in communication with the door arm generates a position signal corresponding to the position of the door relative to the frame. A controller communicates with the sensor and the motor. The controller controls a motor current to the motor in response to the current signal and the position signal.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
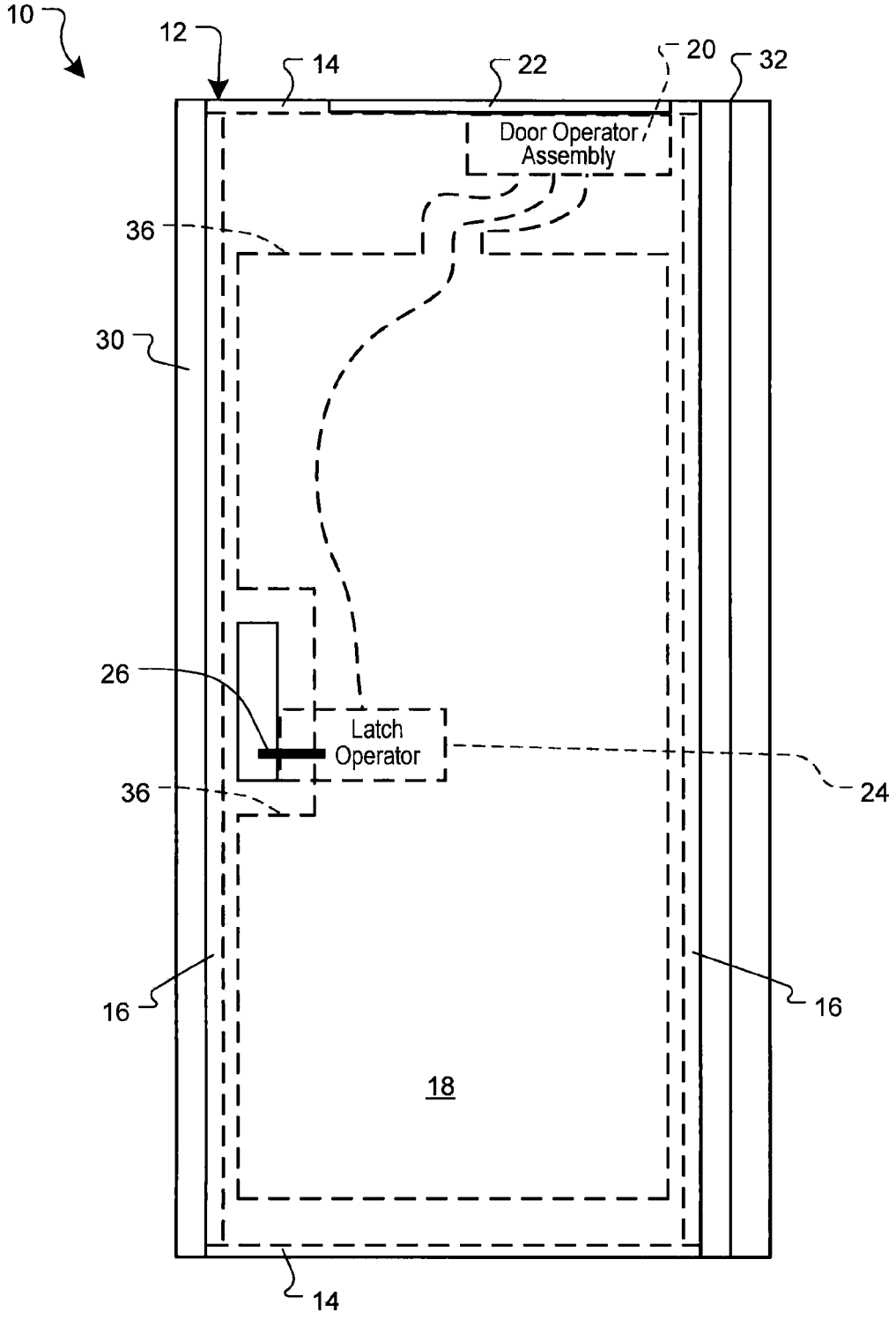
FIG. 1 is a front elevational view of a door having a door operator assembly according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, the present disclosure us set forth with respect to a door 10. The door 10 has a frame 12 that comprises horizontal stiles 14 and vertical stiles 16. The horizontal stiles 14 and vertical stiles 16 may be formed of a variety of materials, including wood, metal or a composite material.

The door 10 has a pair of outer faces 18, only one of which is illustrated in FIG. 1. The outer faces 18 may be referred to as "door skins." The outer faces 18 may comprise various materials, including metal, wood and composite materials. The interior of the door 10 between pieces of the door frame 12 and the door skins 18 may be filled with various materials, including, but not limited to, spacers and fire resistant materials, depending on the type of door.

The door 10 may also include a door operator assembly 20. Although the door operator assembly 20 is described below as being disposed within the door 10 between the door skins 18, the door operator assembly 20 may be disposed partially within the door or on the face of the door. The door operator assembly 20 may be springless to reduce the size of the operator assembly 20. By forming the door operator assembly without a return spring, the forces that the door operator controls are more easily and safely controlled. Not having to overcome the return spring force allows a reduced size for the components within the door operator assembly 20 including the motor.

The door operator assembly 20 includes an arm 22 extending from the door operator assembly 20 that may be used to position the door 10 and move the door into the desired position. The arm 22 may extend from the door operator to the door frame or to a track on the wall adjacent to the door frame. The arm 22 may also be a compound arm common to closers and automatic operators. A latch operator 24 may also be disposed within the door skin 18. The latch operator 24 is associated with a door handle 26 that latches and unlatches the door. The latch operator 24 may be an electrically-operated latch operator, such as a motor or solenoid. The latch operator 24 may be in communication with the door operator assembly 20 and may operate under the control of the door operator assembly 20. The latch operator may also initiate the opening cycles. (Details of the operation of the door operator assembly 20 and the latch operator 24 will be provided below.) The latch operator 24 may be a mechanical operator that is electrically locked or operated in response to sensing the movement of the door handle 26. One example of a mechanical latch operator is a panic bar. The latch operator 24 may be in communication with a latch mechanism 30 that is used for latching the door 10 within an external frame, as described below. A hinge 32 is used for rotating the door 10 within the external frame. Both the latch mechanism 30 and the hinge 32 may extend vertically along the entire edge of the door 10.

A proximity sensor 36, such as an antenna, may also be incorporated within the door 10. By providing the proximity sensor 36 within the door 10, the aesthetic appeal of the door is maintained. The proximity sensor 36 may sense the approach of an object or person and the speed of an object or person, and allow the door operator assembly 20 to operate accordingly. The proximity sensor 36 is in communication with the door operator assembly 20.

Figure 2:
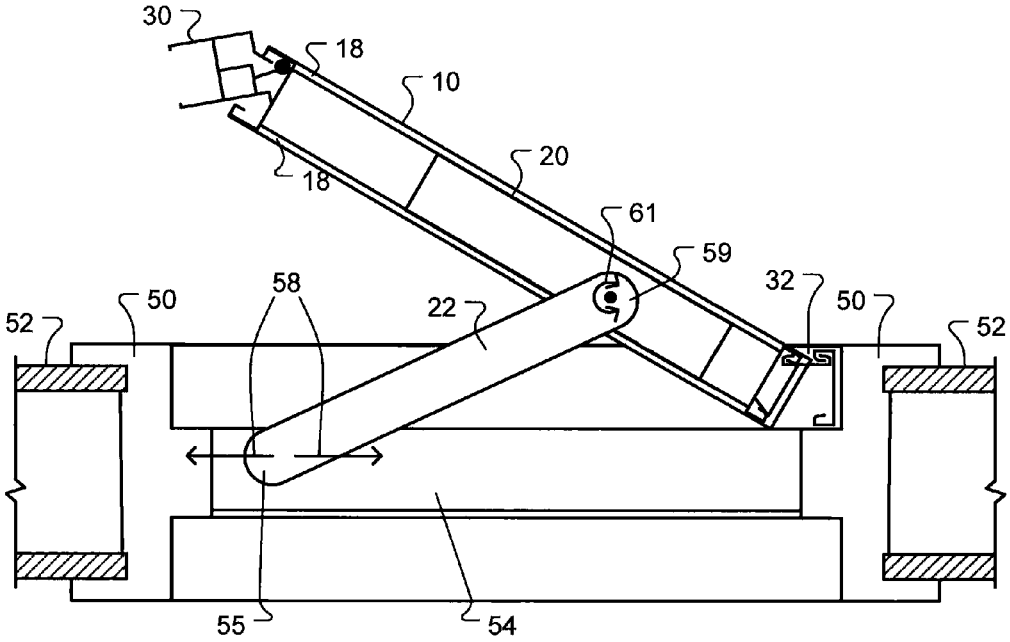
FIG. 2 is a top view of the door and door operator assembly of FIG. 1.

Referring now to FIG. 2, the door 10 is illustrated within an external door frame 50. The door frame 50 fastens the door 10 to a wall 52. The hinge 32 allows the door 10 to pivot about an axis within the frame 50. The door frame 50 may include or have an additional track 54 that allows a first end 55 of the operator arm 22 to slide therein in the direction indicated by arrows 58. As the position of the arm 22 rotates (as indicated by arrow 61) at a second end 59 to change the position of the door 10. The arm 22 is ultimately operated by motor and gear components within the door operator assembly 20, as will be further described below. Latch mechanism 30 engages the door frame 50 or another door in a double-door application.

Figure 3:
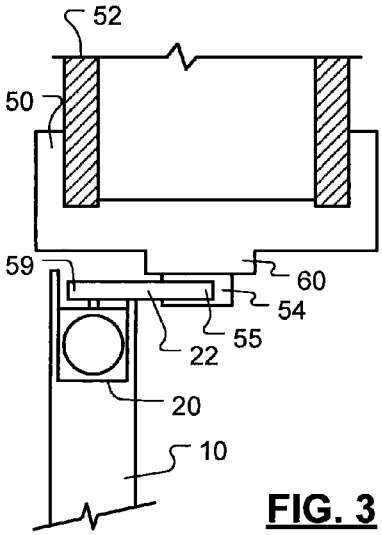
FIG. 3 is a side cut-away view of a door operator assembly for use in a retrofit situation.

Referring now to FIG. 3, a side cut-away view of a door 10 is shown, illustrating a door operator assembly 20 having the arm 22 attached thereto. The arm 22 may be attached to a motor within door operator assembly 20, as will be described below. The first end 55 of arm 22 slides within the track 54 associated with a door frame 50. The track 54 may be referred to as a "concealed track" or "U-shaped" since only one end of the channel forming the track is open. That is, the track 54 may have a top side and a bottom side, and one of the sides opened to receive the arm 22. A stop 60 is integrally-formed with the door frame 50. The door 10 rests against the stop 60 in a closed position. The configuration of FIG. 3 is suitable for retrofitted doors in which the track 54 is added to the stop 60 and the door 10 then assembled within the door frame 50 to receive the arm 22.

Figure 4:
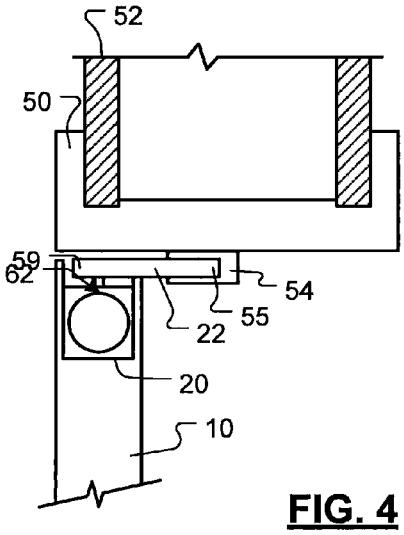
FIG. 4 is side cut-away view of a door with an originally-fitted closer.

Referring now to FIG. 4, a new construction type door assembly 62 is illustrated in which the track 54 is integrally formed with or attached to the top of the door frame 50 without a stop 60, as illustrated in FIG. 3. As the door 10 opens and closes under the influence of the door operator assembly 20, the first second end 55 of the arm 22 remains within the track 54.

Figure 5:
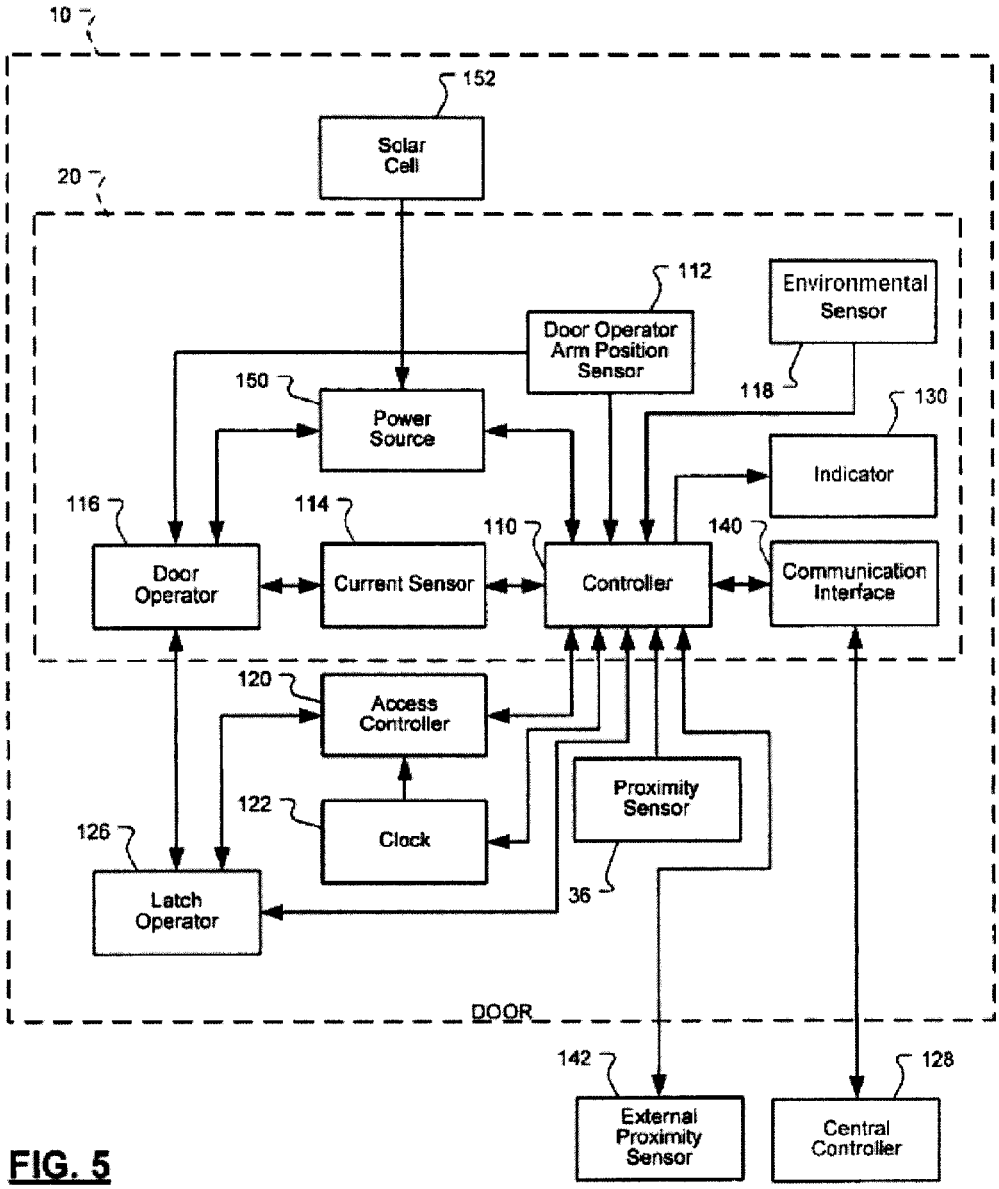
FIG. 5 is a block diagrammatic view of a door system according to the present disclosure.

Referring now to FIG. 5, the door 10 and the door operator assembly 20 are illustrated in further detail. The door operator assembly 20 includes a controller 110. The controller 110 may, for example, be a microprocessor-based controller. The controller 110 may be used to control various actions or outputs based upon various inputs.

The controller 110 may receive an input from a door operator arm position sensor 112. The door operator arm position sensor 112 generates a signal corresponding to the angular position of the operator arm 22. The angular position may be the position relative to the door 10. As the door 10 opens, the angular position signal corresponds to a larger angle than when the door is in a closed position. In a closed position, the angular position may be about zero. Various types of sensors may act as the position sensor 112, including a resistive sensor, a Hall Effect sensor, a pulse-counting sensor or an accelerometer that counts the amount of angular pulse signals from a door operator. Various types of sensors may be used. Based on the position sensor, the change in position over time, such as the opening speed and closing speed, may be obtained. The controller may supply only enough energy or current to overcome friction and inertia to maintain a programmed speed. The acceleration or change in speed over time may also be derived from the position sensor. The force of the door may also be derived based upon the acceleration derived from the position sensor 112 and the mass of the door which may be determined during manufacture or estimated based on the features of the door assembly. The closing force of the door may be charged to overcome stack pressure of the building and physical obstructions. The closing force may be maintained below a predetermined force. The speed may also be maintained below a predetermined speed. The controller 110 may be able to distinguish between an object or stack pressure based on various sensors and a current or speed profile.

The controller 110 may also be in communication with a current sensor 114. The current sensor 114 generates a current signal corresponding with the amount of current being applied to a door operator 116. The controller 110 may control a door operator 116. The door operator 116 may be various types of door operators, as will be described below. The door operator 116 may, for example, be a motor, a motor with a hydraulic pump or a pump with a plurality of gears, such as a rack gear or the like. By monitoring the current within the current sensor 114, the controller 110 can provide more or less opening force, change the velocity of the door opening or closing, or change the acceleration of the door opening or closing.

The motor of the door operator 116 may act as a generator to recover kinetic energy from the opening process. As will be described below, upon a power failure or sensing of a power interruption, the motor may only act to close the door from an open position to a closed position. When the door is pushed open, the motor may act as a generator to recharge a rechargeable power source such as a battery or capacitor.

The controller 110 may also receive environmental signals from an environmental sensor 118. The environmental sensor 118 may be one sensor or a plurality of sensors that sense the environmental conditions around the door 10. One example of an environmental sensor 118 is a smoke detector that generates a smoke signal in response to a smoke condition. The environmental sensor 118 may also be a temperature sensor that senses the temperature around the door 10. The environmental sensor 118 may also be a toxic agent sensor that generates a toxic agent signal in the presence of toxic agents. Various types of toxic agents may be sensed, including, for example, radiation. Light levels may also be sensed by the environmental sensor 118. That is, the environmental sensor 118 may be a light sensor that generates a light signal corresponding to the amount of ambient light within an area around the door 10.

The environmental sensor 118 may sense one or more atmospheric conditions around the door such as wind, rain, snow, weather and other conditions. Based on these conditions, the controller 110 may generate an immediate speed for motor current change in response to the environmental condition or conditions.

The controller 110 may also be in communication with an access controller 120. The access controller 120 may provide access for latching and unlatching the door through a latch operator 126. The access controller 120 may be a PIN pad, a fingerprint recognition system, a voice recognition system, a retina recognition system, or various combinations of the above. The access controller 120 may also be a card reader or the like. The access controller 120 may also be in communication with a clock 122 that records the time of various entries and exits through the door 10. In conjunction with the access controller 120, specific persons may be tracked based upon entry using the access controller 120. The access controller 120 may also monitor and track attendance of various assets and the movement of the access or attendance of various persons or access within a building. The access controller 120 and clock 122, in combination, may also unlock and lock various doors of a building based upon the calendar within the clock and the time associated with the clock.

The controller 110 may also control a latch operator 126. The latch operator 126 may be a mechanical-based or electrical-based latch operator. The latch operator 126 may be used to lock the door 10 based upon inputs from the clock 122 or other inputs such as those from a central controller 128. The latch operator 126 may allow the latch to be unlatched without the intervention of a person. By unlatching the door 10, the latch operator 126 may then be easily moved by the motor associated with the door operator 116 into the desired position.

The proximity sensor 36 may also be an input to the controller 110. The proximity sensor 36 may be one of a variety of sensors, such as the antenna illustrated in FIG. 1. Other types of proximity sensors 36 may be included within the door 10 and outside the door. For example, the proximity sensor 36 may be a motion detector that can gauge the speed of an approaching person or object and open the door 10 corresponding to the speed of the approaching person or object. On example of a suitable use is to sense the speed of an approaching gurney in a hospital environment. The proximity sensor 36 may also be a wall switch that activates door operator 116, or other type of sensing device, such as a floor-mounted pad sensor. The proximity sensor 36 may also generate a signal to the controller 110 that, in response the proximity sensor 36, unlatches the latch through the latch operator 126. Thus, a latch open signal may be generated by the controller 110 to unlatch the latch based upon a proximity signal corresponding to a person or object in proximity of the proximity sensor 36. The latch operator 126 may also generate a latch completion signal to signal the controller 110 that opening the door 10 is enabled since the latch is open.

The controller 110 may also be communication with an indicator 130. The indicator 130 may be an audible indicator, such as a buzzer, beeper or bell, or a visual indicator, such as a light-emitting diode, a display or a light. Audible signals, visual signals or both may be used in a particular system. The indicator 130 may generate an indicator in response to an alarm. By knowing that a particular door should not be opening and when the arm position sensor 112 generates a signal corresponding to the opening of the door during a guarded time period, the indicator 130 may generate an indicator corresponding to an alarm.

The controller 110 may also be in communication with a communication interface 140. The communication interface 140 may communicate with the central controller 128 or other door controllers of a building. The communication interface 140 generates signals in the proper format and potentially with encryption to the central controller 128. The controller 110 may communicate alarm signals to the central controller 128 through the communication interface 140. The central controller 128 may also generate control signals to the controller 110 to change various time periods associated with the door 10, such as lock-down times, door-opening times, speeds and accelerations.

An external proximity sensor 142 may also be in communication with the controller 110. The external proximity sensor 142 may be a wall-mounted switch or motion-detecting device that communicates a proximity sensor signal to the controller 110.

A power source 150 may be in communication with the door operator assembly 20. The power source 150 may, for example, be in communication with the door operator 116 and the controller 110. The power source 150 may be internal or external to the door assembly. A power failure sensor 151 may be coupled to the power source 150 that generates a signal that is indicative of a power failure or power interruption. The sensor 151 may be located in various locations of the door operator assembly 20. A door assembly may have backup power because sensing a power failure on incoming power is important so that the controller 110 may change modes and operate differently if required.

Other devices within the door 10 may also be in communication with the power source 150 such as the latch operator 24 and various sensors. The power source 150 may be a rechargeable power source such as a battery or capacitor that is used to operate the door operator assembly 20. The power source 150 may be located between the door skins 18 illustrated in FIG. 2 within the door 10. The power source 150 may be a rechargeable power source that is recharged by a solar cell 152. The power source 150 may also be easily removable so it can be readily replaced.

FIGS. 6A-6D provide alternative embodiments to the layout within the door cavity.

Figure 6A:
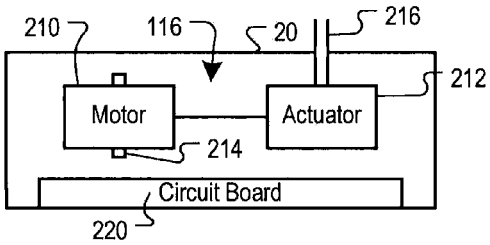
FIG. 6A is a simplified block diagrammatic view of the motor and actuator of a door operator assembly.

Referring now to FIG. 6A, the door operator assembly 20 is illustrated with a high-level block diagrammatic view. In this embodiment, the door operator 116 may comprise a motor 210 and an actuator 212. The motor 210 may have a vertical axis 214 oriented in a vertical direction. The actuator 212 may comprise gears and the like. The actuator 212 may comprise various types of gears, including planetary gears, worm gears, spur gears, and the like. The actuator 212 has a shaft 216 that is rotatably coupled to the arm 22 of FIGS. 1 and 2. Each of the embodiments below have the shaft 216 rotatably coupled to the arm 22.

A circuit board 220 may be incorporated within the door operator assembly 20. The circuit board 220 may house the controller and various other components, as described below. Sensors may also be disposed on the circuit board 220. The circuit board 220 may comprise one circuit board or multiple circuit boards that are arranged to fit between the outer skins illustrated in FIG. 2 of the door. Each of the embodiments below may include the circuit board 220.

Figure 6B:
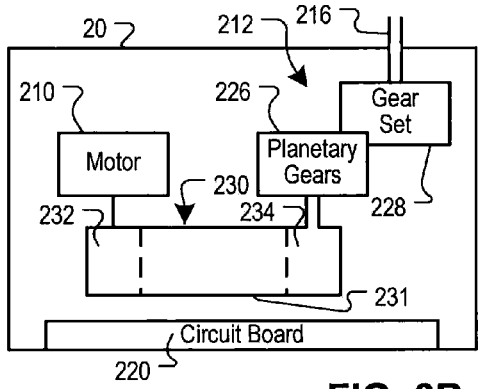
FIG. 6B is an alternative simplified block diagrammatic view of the door operator assembly.

Referring now to FIG. 6B, the actuator 212 of FIG. 6A may include planetary gears 226 and a secondary gear set 228. The secondary gear set 228 may comprise spur gears or the like. The motor 210 may be coupled to the planetary gears 226 using a belt drive 230. A belt 231 extends from a first gear 232 coupled to the motor 210 and a second gear 234 coupled to the planetary gears 226.

Figure 6C:
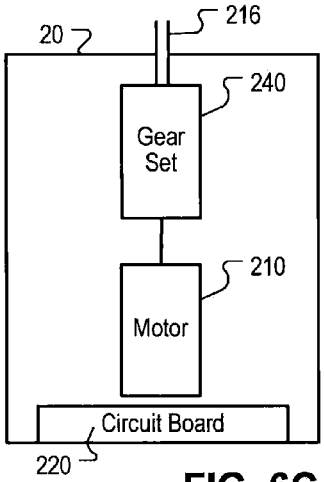
FIG. 6C is another alternative simplified block diagrammatic view of the door operator assembly according to the present disclosure.

Referring now to FIG. 6C, the motor 210 is oriented axially with a gear set 240. The gear set 240 is in communication with the operator arm 22 (not illustrated).

Figure 6D:
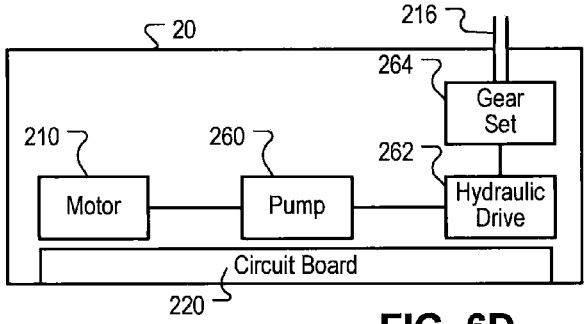
FIG. 6D is yet another alternative simplified block diagrammatic view of the door operator assembly operated under the control of a motor and hydraulics.

Referring now to FIG. 6D, the motor 210 is used to drive a pump 260. The pump 260 is in fluid communication with a hydraulic drive 262. By increasing the speed of the motor 210, various pressures of hydraulic fluid may be provided to the hydraulic drive 262. A gear 264, which may be different or similar to the gear sets 240, 228 described above, may couple the hydraulic drive 262 to the arm 22.

In each of the embodiments illustrated in FIGS. 6A-6D, the motor 210 and actuator are sized to be fully received between the door skins of the door 10. The gears are sized and positioned to convert the rotary motion of the motor 210 into motion of the arm 22, which in turn opens or closes the door 10.

Figure 7:
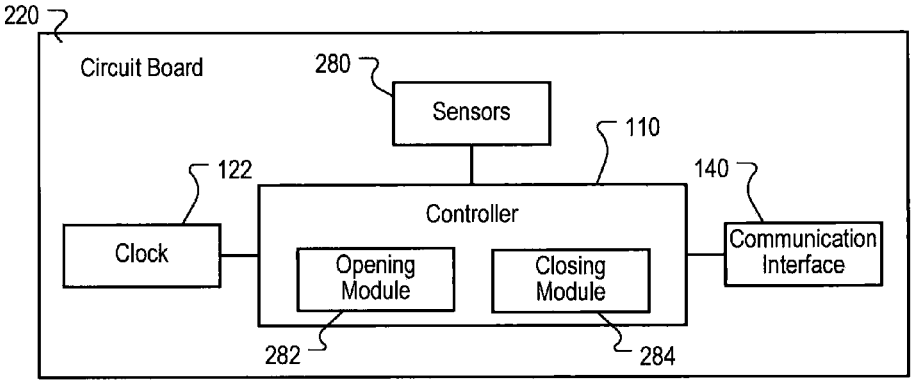
FIG. 7 is a simplified block diagrammatic view of a circuit board for use in the door operator assembly.

Referring now to FIG. 7, the circuit board 220 of FIGS. 6A-6D is illustrated. Various components may be mounted on or coupled to the circuit board 220. Various sensors are illustrated with reference numeral 280. The various sensors 280 may be the sensors illustrated in FIG. 5. At least some of the sensors 280 may be mounted directly on this circuit board 220.

The controller 110 may include an opening module 282. The opening module 282, based upon the various sensors 280, may control the opening position, opening speed and opening acceleration of the door relative to the door frame. The opening module 282 may be disabled during a power failure. A power failure may cause the motor to act as a generator during operating of the door so that a power source may maintain a charge. The charge may be capable of being maintained indefinitely.

A closing module 284 may also be provided within the controller 110. The closing module 284 may control the closing position, closing speed and closing acceleration of the door 10 of the controller 110. Both the opening module 282 and the closing module 284 may have several regions defined for different speeds, accelerations and positions. For example, the opening module 282 may provide an unlatching force in a first range, which corresponds to providing a predetermined current to obtain a predetermined velocity of the door at a predetermined acceleration. Once the door is unlatched and opened greater than a first predetermined amount, the first door speed or acceleration may be adjusted by controlling the motor current to a second door speed or acceleration. When close to being open after a second predetermined door position, the door speed or acceleration may change. Of course, multiple regions corresponding to the position may be provided so that different speeds of the door may be provided. The closing module 284 may, likewise, have different speeds and velocities associated with various positions. Several regions may also be provided for the closing module 284. When the door is nearly closed, the velocity for latching may be maintained by increasing the current to the motor to overcome the stack pressure of the building. Also, both modules 282 and 284 may compensate for wind pressure in either direction. That is, a wind forcing the door open while the opening module 282 is opening the door may require a resistive current to resist the speed of the wind. Likewise, if the wind is against the opening direction, additional current may be required to maintain the desired velocity of the door. The clock 122 and communication interface 140 may also be incorporated onto circuit board 220. The closing module may compensate for stack pressures as the door closes. The stack pressures may change and therefore the system also changes the current to the motor based on the speed of the door closing. That is, if more force is required due to stack pressure increases, more current is provided to the motor for closing.

Figure 8:
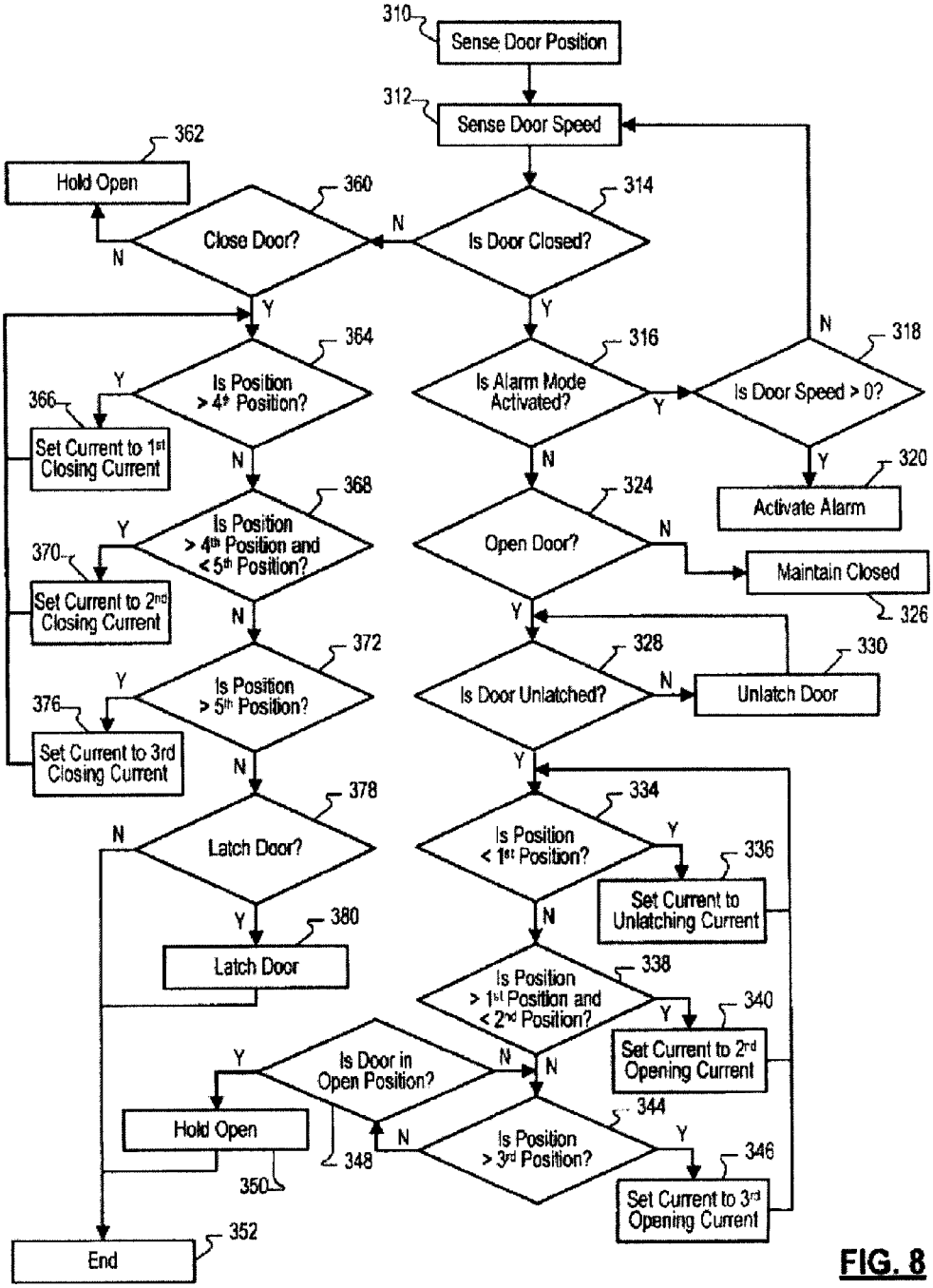
FIG. 8 is a flowchart showing a method of operating the door operator assembly of the present disclosure.

Referring now to FIG. 8, one method of operating the door is set forth. In step 310, the position of the door is sensed by the door operator arm position sensor 112 illustrated in FIG. 5. In step 312, the speed of the door relative to the frame is sensed (or derived). As will be described below, the position and the speed of the door allows the controller to control the current to maintain desired speeds and positions. In step 314, it is determined whether the door is closed. If the door is closed, step 316 determines whether an alarm mode has been activated. In an alarm mode, the door should not open. If an alarm mode has been activated in step 316, step 318 determines the door speed. If the door speed is not greater than zero, then step 312 is again performed. In step 318, if the door speed is greater than zero, then an alarm is activated in step 320.

Referring back to step 316, if the alarm mode has not been activated, it is determined whether the door is desired to be opened in step 324. If the door is not desired to be opened, step 326 is performed. Step 326 maintains the door in a closed position.

In step 324, if the door is desired to be opened, it is determined whether the door has been unlatched. If the door has not been unlatched, the door may be unlatched in step 330. The unlatching of the door may be mechanically or electromechanically performed using the latch operator. If the door is unlatched, step 334 is performed. In step 334, it is determined whether the position of the door is less than a first position. The position of the door is determined constantly throughout the process since the door is ever changing. When the door is less than the first position, the current is set to an unlatching current in step 336. If the position is not less than first position, it is determined whether the position is between a first position and a second position in step 338. If the current is between a first and a second position, step 340 sets the current to a second opening current. In step 338, if the position of the door is not between a first position and a second position, step 344 may be performed. Step 344 determines whether the position is greater than a third position, but less than a fully-opened position. If the position is between the third position and the fully-opened position, step 346 sets the current to a third operating current. If the position is not between the third position and the fully-opened position, step 348 determines whether the door is in the opened position. If the door is not in the opened position, step 344 is again performed. If the door is in the opened position, step 350 holds the door in the open position. Step 352 ends the process.

Steps 336, 340 and 346 illustrate various operating currents that are used that correspond to various positions of the door. Different currents may be used to obtain different speeds or accelerations, as will be set forth in FIG. 10. Although the three different door positions and the opened positions are set forth, various numbers of positions corresponding to different currents may be provided, including less than three positions, such as one current for the entire door swing or more than three intermediate positions.

Referring back to step 314, it is determined whether the door is desired to be closed in step 360. If the door is not desired to be closed in 360, step 362 holds the door open. It should be noted that the hold open current for the door in step 362 and step 350 above may be a relatively low current since a return spring is not provided in the present configuration. In step 364, it is determined whether the position of the door is greater than a fourth position. If the position is greater than a fourth position, the closing current may be set to a first closing current in step 366. In step 364, if the position is not greater than a fourth position, step 368 is performed. In step 368, it is determined whether the position is between a fourth position and a fifth position. If the position is between a fourth position and a fifth position, the current may be set to a second closing current in step 370. If the position is not between a fourth position and a fifth position, step 372 may be performed. In step 372, it is determined whether the position is greater than a fifth position. If the position is greater than a fifth position, step 376 is performed. If the position is not greater than a fifth position, step 378 may be performed. In step 378, it is determined whether or not the door is to be latched. If the door is not to be latched, the method ends in step 352. If the door is to be latched in step 378, the door is latched in step 380 and the process ends in step 352. The door may be mechanically or electro-mechanically latched in step 380.

Figure 9:
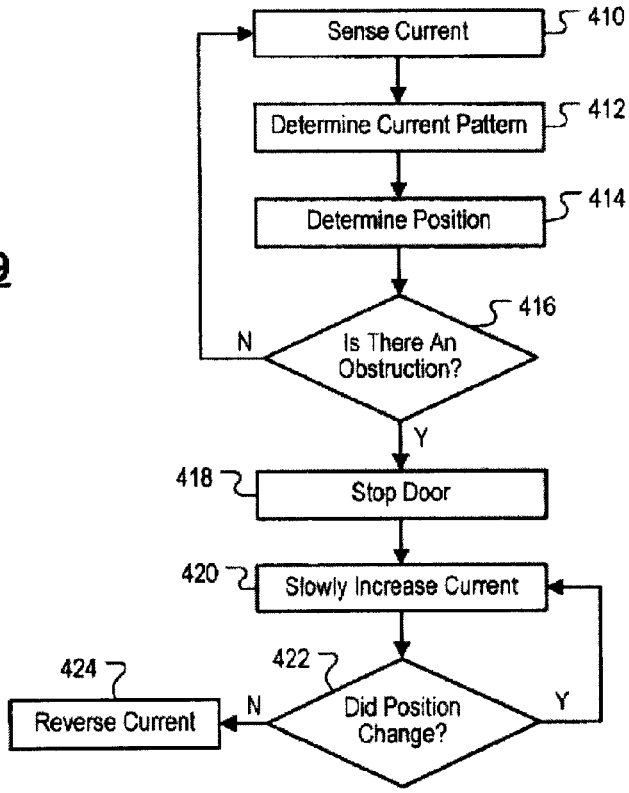
FIG. 9 is a flowchart showing a method for controlling the operating current of the door in the present disclosure.

Referring now to FIG. 9, during the entire operating process of FIG. 8, the current may be sensed. This is illustrated in step 410. In step 412, a current pattern may be determined. The current pattern may look at the current for a time preceding the last current reading. The current readings may be performed at regular intervals. In step 414, the position of the door may also be used to determine whether or not an obstruction is present. In step 416, an obstruction is determined. An obstruction may be determined by looking at the current pattern, the position of the door or both. If there is no obstruction, step 410 is again performed. Examples of obstructions may include a person contacting the door, door latch or door hinge. For example, fingers in the door hinge or latch may be an obstruction.

In step 416, if there is an obstruction, the movement of the door is stopped in step 418. It should be noted that the detection of the obstruction may be performed when the door is both opening and closing. In step 420, the current is slowly increased. If the position does change in step 422, the current is continually increased. If the position does not change in step 422, the current is reversed in step 424 to back up the door position to a previous position.

Figure 10:
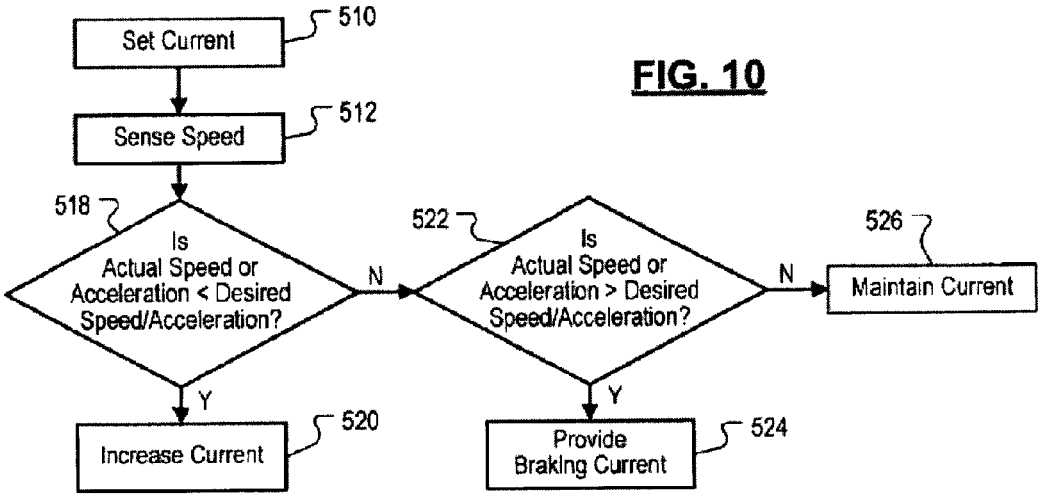
FIG. 10 is a flowchart showing a method for setting and changing the operating current of the door.

Referring now to FIG. 10, the setting of the current in steps 336, 340, 346, 366, 370, and 376 of FIG. 8 are illustrated in further detail. Each of the steps 336, 340 and 346 may have similar elements and are, thus, described here in further detail. In step 510, the current is set as provided above in one of the steps, such as 336, 340 and 346. In step 512, the speed of the moving door is determined. In step 518, the actual speed of the door or the acceleration is compared to a desired speed or desired acceleration. It should be noted that the acceleration of the door may be determined by determining a change in the speed sensed in step 512. In step 518, if the actual speed or acceleration is less than a desired speed or acceleration, the current may be increased in step 520. This allows the actual speed or acceleration to be increased to the desired speed or acceleration. It should be noted that both the speed and the acceleration may be increased by increasing the current in step 520. If the actual speed or acceleration is not less than the desired speed or acceleration, step 522 is performed. In step 522, if the actual speed or acceleration is greater than the desired speed or acceleration, step 524 is performed. In step 524, a braking current is provided to prevent the door from going faster than the desired speed or acceleration. This may occur when someone or some force is pushing on the door. The force may include a person pushing on the door or wind. If the actual speed or acceleration is not greater than the desired speed or acceleration, the system is operating as it should and the current is maintained in step 526.

Figure 11:
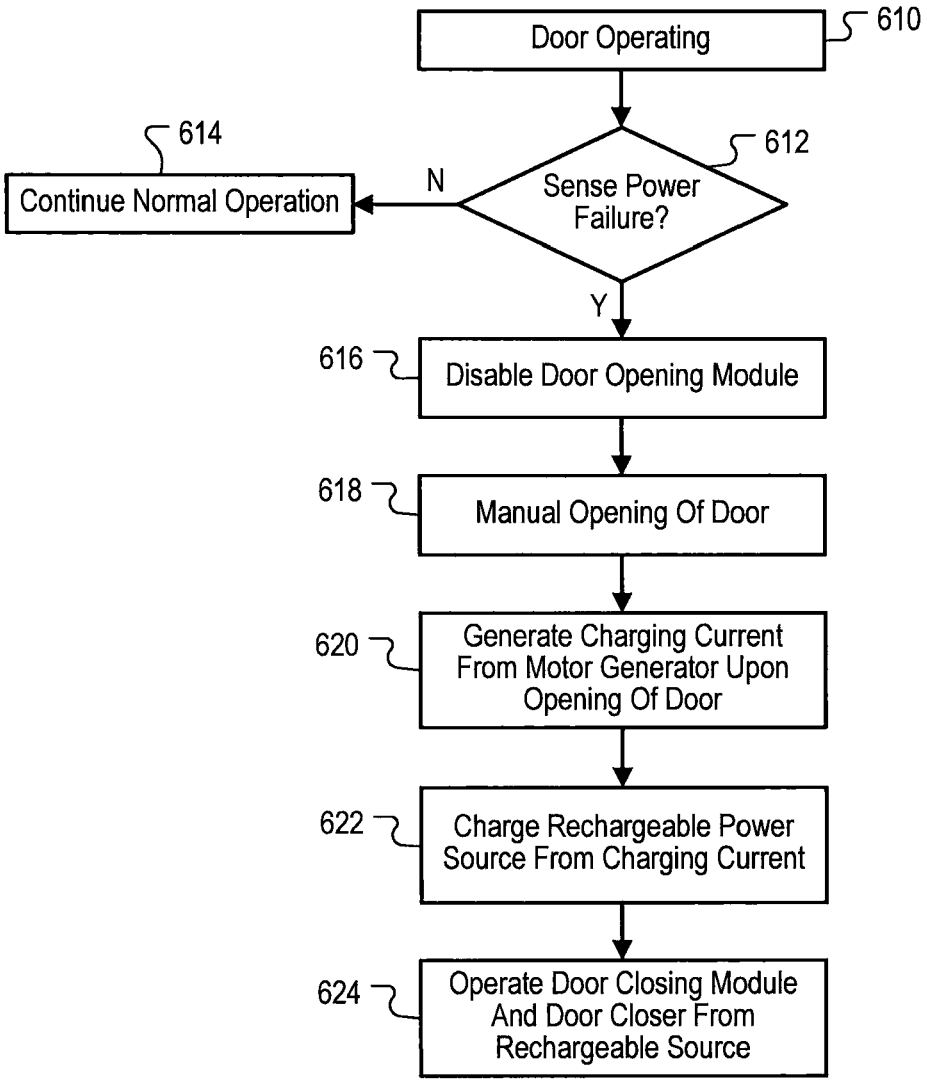
FIG. 11 is a flowchart of a method for operating the door during a power failure.

Referring now to FIG. 11, a method for operating a door during a power failure is set forth. In step 610, the door is operating, e.g., opening and closing. In step 612, it is determined whether a power failure has been sensed. A power failure sensor as described above may be provided to determine whether a power failure has occurred. A power failure may occur when the power to the door from an external source has been interrupted. If a power failure has not been determined, step 614 continues normal operation.

In step 612, when a power failure has been sensed, step 616 disables the door opening module 616. If the system does not include a door opening module, the use of the door operator assembly is disabled for the opening of the door. In step 618, the door may be opened manually by a user of the door. During manual opening of the door, the motor acts as a generator and generates charging current upon the opening of the door. The charging current is provided to the rechargeable power source in step 622 to charge the rechargeable power source. In step 624, the door closing module operates the door to a closed position after the door has been opened from the rechargeable power source.

Figure 12:
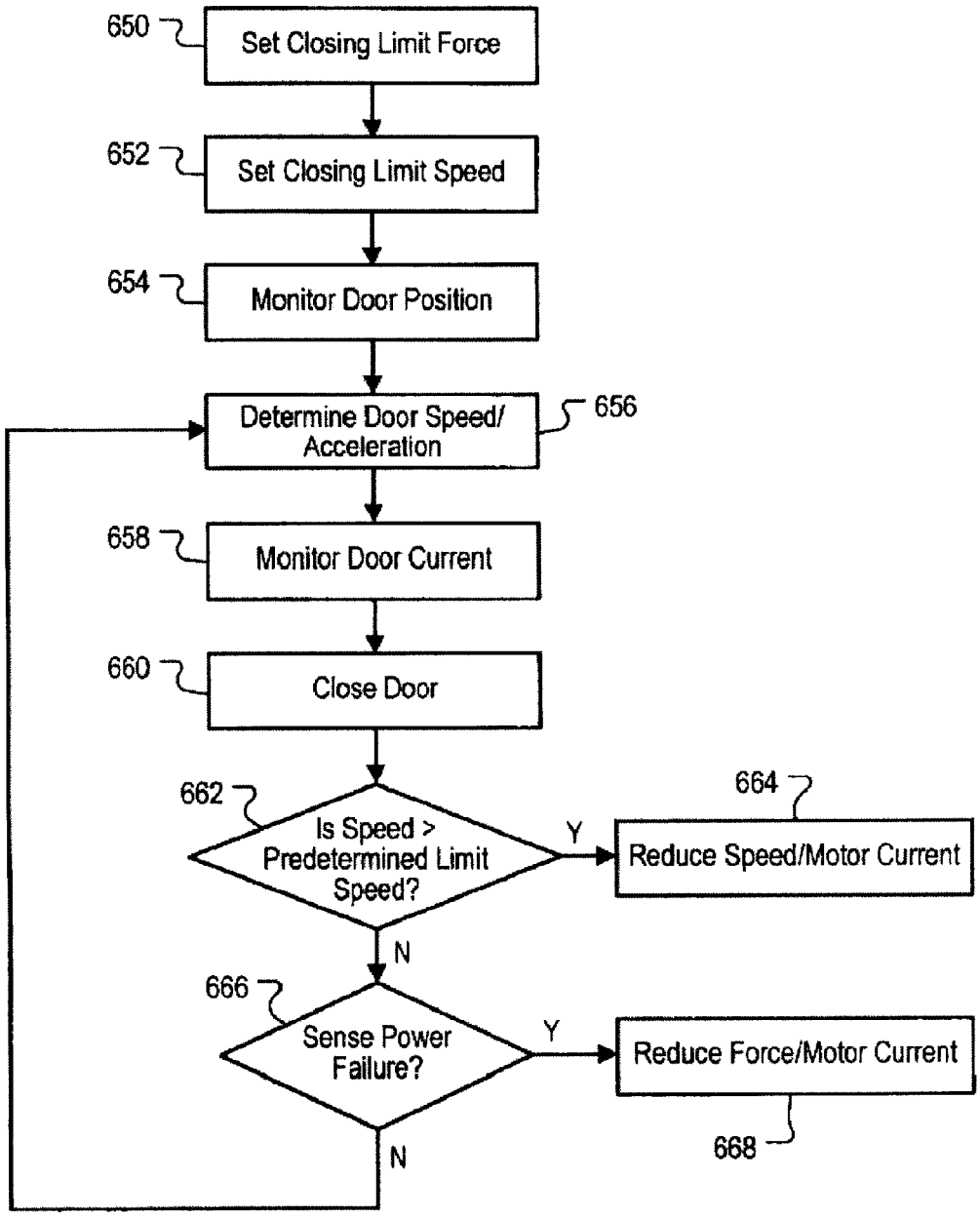
FIG. 12 is a flowchart of a method for operating the door using a predetermined limit speed and predetermined force limit.

Referring now to FIG. 12, a method for operating the door using a force limit is set forth. In step 650, a closing limit force is established. The closing limit force may, for example, be in the range of about 1.5 lbs. to about 2.0 lbs. of force. Of course, various ranges of forces may be used depending upon the application. The closing limit force may change, as mentioned above, depending upon various angles of the door. When the door is nearly closed, an increased limit force may be set so that stack pressures may be overcome.

In step 652, a closing limit speed may also be set. When monitoring the closing limit speed, the motor current can be increased to overcome stack pressures in the final closing motion.

In step 654, the door position is monitored during operation. In step 656, the door speed and acceleration may be derived from the door position and also monitored. In step 658, the door current may be monitored. In step 660, the door is closed using the door closer.

In step 662, when the speed is greater than a predetermined limit speed, the speed may be reduced using the motor current 664. The motor current may provide a braking current to reduce the speed to a predetermined value.

If the speed is not greater than the predetermined limit speed in step 662, step 666 determines whether the force is greater than a predetermined force. If the force is greater than a predetermined force, step 668 reduces the force by reducing the motor current. In step 666, if the force is not greater than the predetermined force, steps 654-666 are again performed.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A door operator for a door comprising:

a motor moving an arm to move the door between a closed position and an open position and between the open position and the closed position;

a current sensor generating a current signal corresponding to a current to the motor;

a position sensor in communication with the arm generating a position signal corresponding to the position of the door relative to a frame;

a controller communicating with the current sensor, the position sensor and the motor, said controller controls the current to the motor in response to the current signal and the position signal so that door movement speed is below a limit speed and a corresponding closing force is below a predetermined force, and a gear set, and a belt in communication with the motor and the gear set, said gear set operating the door arm in response to movement of the belt, wherein the gear set comprises planetary gears, and said door operator is springless.

2. The door operator as recited in claim 1 wherein the controller increases the current to the motor to obtain a predetermined movement speed.

3. The door operator as recited in claim 1 wherein the controller changes the current to the motor based on the position signal.

4. The door operator as recited in claim 1 wherein the controller changes the current to the motor based on the position signal at least three times between the open position and the closed position.

5. A door assembly comprising:

the door operator as recited in claim 1, the door, coupled to the arm; and a latch operator in communication with the controller, said controller controlling the current to the motor in response to a latch operator signal.

6. The door assembly as recited in claim 5 wherein the door comprises a first door skin, and a second door skin spaced apart from the first door skin; and the latch operator is disposed between the first door skin and the second door skin.

7. The door operator as recited in claim 1 further comprising an access controller in communication with the controller, said access controller enabling opening of the door.

8. A door assembly comprising:

the door operator as recited in claim 7; and the door, coupled to the arm, the door comprising a first door skin, and a second door skin spaced apart from the first door skin;

wherein the access controller is disposed at least partially between the first door skin and the second door skin.

9. A door assembly comprising:

the door operator as recited in claim 1;

the door, coupled to the arm; and a proximity sensor generating a proximity signal corresponding to an object approaching the door, said controller controlling the current to the motor in response to the proximity signal.

10. The door operator as recited in claim 1 further comprising an environmental sensor in communication with the controller, said environmental sensor generating an environment signal.

11. The door operator as recited in claim 10 wherein the environmental sensor comprises at least one member selected from the group consisting of a smoke sensor, a toxic agent sensor, a light sensor, an atmospheric condition sensor and a heat sensor.

12. The door operator as recited in claim 11 wherein the door operator comprises a rechargeable power source.

13. The door operator as recited in claim 12 wherein the controller determines a power failure and said controller controlling the motor to move the arm to move the door between the open position and the closed position and recharging the rechargeable power source using the motor as a generator when the door is moved from the closed position to the open position.

14. The door operator as recited in claim 13 wherein the rechargeable power source is in communication with a solar cell, said solar cell recharging the rechargeable power source.

15. The door operator as recited in claim 1 wherein the controller generates a braking current when the door movement speed is greater than a desired speed.

16. The door operator as recited in claim 1 wherein the controller generates a braking current when the door movement speed is greater than a desired speed for a predetermined position.

17. The door operator as recited in claim 1 wherein a first end of the arm is rotatably coupled to the door and a second end of the arm is slidably coupled within a channel coupled to the frame.

18. The door operator as recited in claim 1 wherein the controller increases the current to the motor in response to the position signal to compensate for a building stack pressure.

19. The door operator as recited in claim 1 wherein the controller changes the current to the motor in response to the position signal to compensate for a physical obstruction to closing the door.

20. The door operator as recited in claim 1 wherein the controller distinguishes between an object and stack or wind pressure.

21. A door assembly comprising:

the door operator as recited in claim 1; and the door, coupled to the arm, the door comprising a first door skin, and a second door skin spaced apart from the first door skin;

wherein the motor, the current sensor, the position sensor and the controller are at least partially disposed between the first door skin and the second door skin.

22. The door operator as recited in claim 1 wherein the gear set comprises:

the planetary gears, spur gears, a first gear coupled to the motor, and a second gear coupled to the planetary gears.

* * * * *